US012799692B2

(12) United States Patent
Bichler et al.

(10) Patent No.: US 12,799,692 B2
(45) Date of Patent: Nov. 17, 2026

(54) PROTECTIVE STRUCTURE

(71) Applicant: Trumer Schutzbauten Ges.m.b.H, Oberndorf (AT)

(72) Inventors: Ahren Bichler, Sechelt (CA); Matthias Jakob, Vancouver (CA); Gernot Stelzer, Kuchl (AT); Alex Strouth, Golden, CO (US)

(73) Assignee: Trumer Schutzbauten Ges.m.b.H, Oberndorf (DE)

( * ) Notice: Subject to any disclaimer, the term of this patent is extended or adjusted under 35 U.S.C. 154(b) by 481 days.

(21) Appl. No.: 18/254,803

(22) PCT Filed: Nov. 29, 2021

(86) PCT No.: PCT/EP2021/083391
§ 371 (c)(1),
(2) Date: May 26, 2023

(87) PCT Pub. No.: WO2022/112563
PCT Pub. Date: Jun. 2, 2022

(65) Prior Publication Data

US 2024/0035241 A1 Feb. 1, 2024

(30) Foreign Application Priority Data

Nov. 30, 2020 (DE) ..... 102020131710.7

(51) Int. Cl.
*E01F 7/04* (2006.01)

(52) U.S. Cl.
CPC ..... *E01F 7/04* (2013.01)

(58) Field of Classification Search
CPC ..... E02D 17/205; E01F 7/04; E01F 7/045; E01F 13/028; E01F 15/088
See application file for complete search history.

(56) References Cited

U.S. PATENT DOCUMENTS 5,387,049 A * 2/1995 Duckett ..... E01F 15/088 404/6
5,605,413 A * 2/1997 Brown ..... E01F 15/025 404/9

(Continued)

FOREIGN PATENT DOCUMENTS

CN 107905130 A 4/2018
DE 8612622 U1 9/1986

(Continued)

OTHER PUBLICATIONS

European Patent Office, International Search Report and Written Opinion of the International Searching Authority in PCT/EP2021/083391, which is a foreign counterpart to this U.S. Application claims priority.

*Primary Examiner* — Matthew R McMahon
(74) *Attorney, Agent, or Firm* — Kolitch Romano Dascenzo Gates LLP

(57) ABSTRACT

The present disclosure relates to a protective structure for the protection against moving masses, namely avalanches, rockfalls, mudslides and loggings, having a plurality of ballast-filled wall elements, which are arranged in a manner adjacent to each other and spaced apart on a bearing surface, and having a respective connection arrangement between two adjacent wall elements which connects the two adjacent wall elements and enables relative movement between the two wall elements. The wall elements are movable in relation to the bearing surface and in relation to each other by the moving mass, namely avalanche, rockfall, mudslide or logging, for dissipative energy conversion.

19 Claims, 3 Drawing Sheets

(56) References Cited

U.S. PATENT DOCUMENTS

| | | | | |
|---|---|---|---|---|
| 6,672,799 | B2 * | 1/2004 | Earl | E02B 3/04 405/116 |
| 7,654,768 | B1 * | 2/2010 | Tullis | E01F 15/083 404/6 |
| 8,256,985 | B2 * | 9/2012 | Ashmead | E01F 13/02 404/6 |
| 8,545,126 | B1 * | 10/2013 | Alsaffar | E01F 15/086 404/6 |
| 8,622,650 | B2 * | 1/2014 | Lifton | E01F 15/086 404/6 |
| 9,677,233 | B2 * | 6/2017 | Welch | E01F 13/022 |
| 10,781,606 | B2 * | 9/2020 | Markham | E01F 13/12 |
| 11,136,736 | B2 * | 10/2021 | Elmore | E01F 15/146 |
| 2021/0363716 | A1 * | 11/2021 | Daniluk | F41H 5/24 |

FOREIGN PATENT DOCUMENTS

| | | | |
|---|---|---|---|
| DE | 202017106965 | U1 | 3/2018 |
| EP | 0562154 | A1 | 9/1993 |
| EP | 1500747 | A1 | 1/2005 |
| KR | 200361762 | Y1 | 9/2004 |
| WO | WO2019091508 | A1 | 5/2019 |

* cited by examiner

PROTECTIVE STRUCTURE

SUMMARY

The present disclosure provides systems, apparatuses, and methods relating to protective structures for protection against avalanches and the like.

In some examples, a protective structure for protection against moving masses (namely avalanches, rockfalls, mudslides, or loggings) includes: a plurality of ballast-filled wall elements arranged in a manner adjacent to each other and spaced apart on a bearing surface; and a connection arrangement between each two adjacent wall elements, which connects the two adjacent wall elements and allows relative movement between the two wall elements; wherein the wall elements are movable in relation to the bearing surface and in relation to each other by the movable mass for dissipative energy conversion.

Features, functions, and advantages may be achieved independently in various embodiments of the present disclosure, or may be combined in yet other embodiments, further details of which can be seen with reference to the following description and drawings.

BRIEF DESCRIPTION OF THE DRAWINGS

Further details, advantages and features of the present disclosure will be apparent from the following description of an example embodiment while reference will be made to the drawings, wherein.

DETAILED DESCRIPTION

Figure 1:
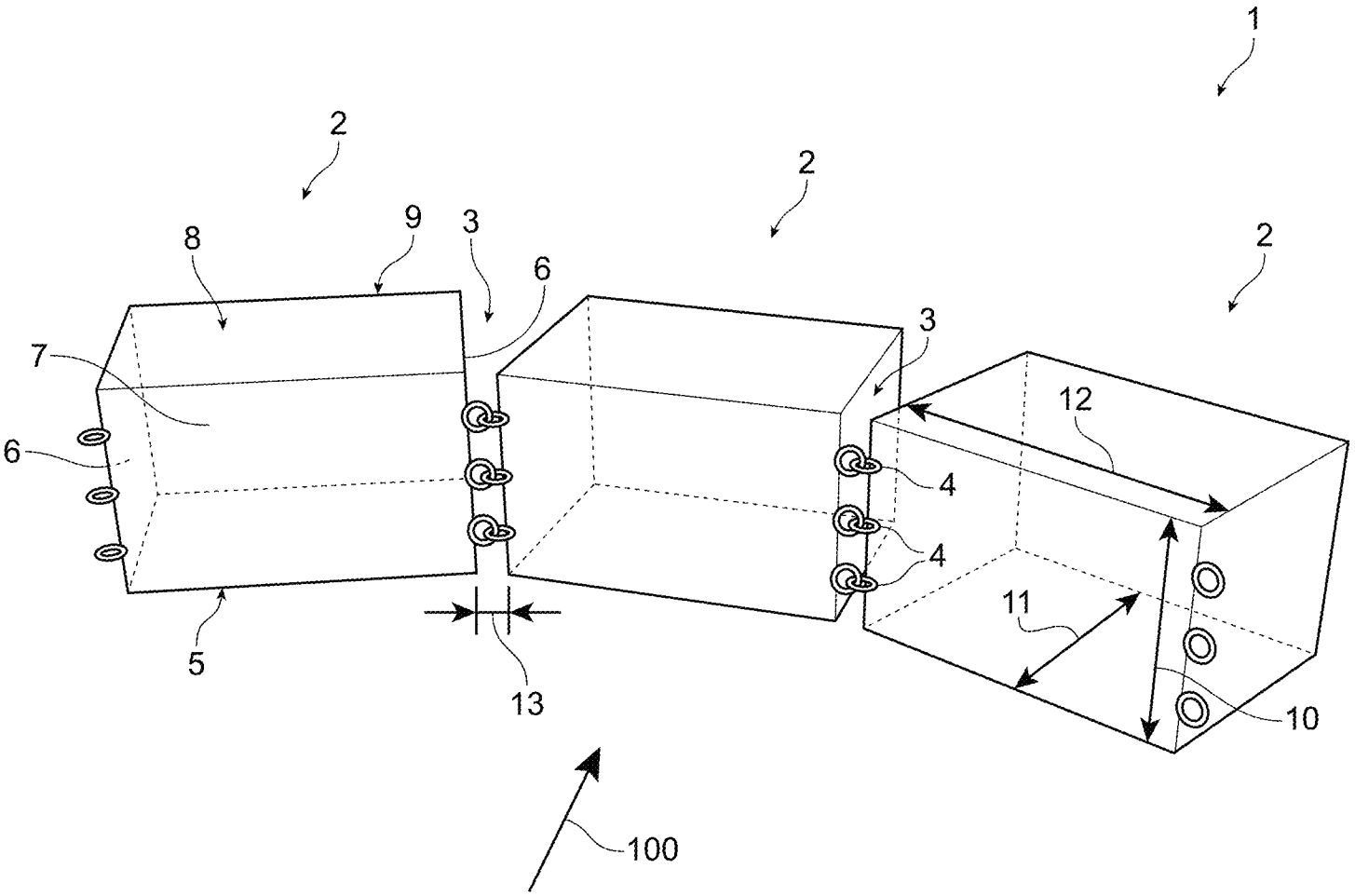
FIG. 1 shows a schematic representation of a protective structure according to the present disclosure according to an example embodiment.

The present disclosure relates to a protective structure for the protection against moving masses, in particular avalanches, rockfalls, mudslides, or loggings.

EP 1 500 747 A1, for example, shows a typical protective structure. Herein, supporting pillars are anchored in the subsoil by means of appropriate foundations, and net structures are spanned between the supporting pillars. In addition to the foundations, the pillars may further be fixed by means of anchors or posts. Erection of the concrete foundations, the anchors and the posts requires specific machinery and is therefore cost-intensive and time-consuming.

It is the task of the present disclosure to provide a protective structure for the protection against moving masses, which provides effective protection while being easy to manufacture.

The present disclosure discloses a protective structure for the protection against moving masses. In particular, the moving masses are avalanches, rockfalls, mudslides, or loggings. The protective structure "protects" against these moving masses in that the masses are slowed down by the protective structure and, in the best case, will completely be stopped. Generally, movement of the masses occurs in a downhill direction. Accordingly, the protective structure is positioned on an incline, at the base of an incline, or in a riverbed that also represents an incline due to its slope.

The protective structure comprises a plurality of ballast-filled wall elements. In the simplest case, at least two of these wall elements are provided. Each wall element is initially hollow. This cavity of the wall element represents a "ballast volume". After positioning the wall element at the desired location, i.e. during the erection of the protective structure, the wall element is filled with ballast.

The individual wall elements, which together form a protective structure, are arranged adjacent to and spaced apart from each other on a bearing surface. Preferably, the bearing surface on which the wall elements are positioned is not sealed, in particular not concreted. Particularly preferably, it is the soil or the rock subsoil that is present anyway; if necessary, the bearing surface may be compacted. In particular, the bearing surface is not a road, and preferably not any other driveway.

The protective structure has at least one connection arrangement arranged between two adjacent wall elements. If only two wall elements are used, a connection arrangement is provided which connects these two wall elements to each other. However, in a preferred embodiment, more than two wall elements are provided. In particular, at least three, preferably at least 4, more preferably at least 5 ballast-filled wall elements are used. These wall elements are positioned adjacent to and spaced apart from each other as if they were lined up on a chain. Two adjacent wall elements are connected by a respective connection arrangement.

At least one of the connection arrangements, but preferably each one of the connection arrangements, is designed such that the two adjacent wall elements can move with respect to each other. In particular, the respective connecting element enables relative rotational movement, in particular about the vertical axis, of the two adjacent wall elements with respect to each other. The vertical axis is defined to be perpendicular to the bearing surface.

The wall elements are designed and positioned such that the moving mass which hits the wall elements allows the wall elements to move in relation to the bearing surface (i.e., in relation to the ground) and in relation to each other. This results in dissipative energy conversion for decelerating the moving mass, thereby providing protection from the moving mass.

An "impact direction" is defined. When erecting the protective structure, it will be assumed that the moving mass will originate from this impact direction. Accordingly, the front faces of the wall elements are turned towards the impact direction. In particular, the at least two wall elements are substantially arranged perpendicularly to the impact direction. The moving mass impinges onto the front faces of the wall elements causing the wall elements to move across the bearing surface. Due to the movable connection arrangement, the wall elements may also move towards each other. In particular, if the movable mass hits the front sides of the wall elements, the wall elements will also move relative to each other.

In particular, if the movable mass hits the center of the chain of wall elements, the wall elements, with their face faces, will move towards each other.

The connection arrangements are in particular designed to connect the respective wall elements to each other in a direct and immediate manner. Particularly preferably, the connection arrangements are solely mounted on the wall elements—and not, for example, on the bearing surface or other elements.

Preferably, the wall elements are arranged without using a foundation. This means that there is no foundation under the wall elements to which or in which they are mounted.

Furthermore, it is preferably provided that the wall elements are arranged without anchors or restraints. This means that the wall elements are not mounted via tie rods, for example. However, in specific embodiments, it is possible to mount the wall elements using tie rods to prevent movement of the wall elements in the event of relatively small impacts. However, such anchorings may then be configured such that, if the expected mass is appropriately large, these anchorings will break off, resulting in movement of the wall elements for dissipative energy conversion.

Preferably, bulk material is used as a ballast for filling the wall elements; in particular stones and/or earth and/or gravel. Preferably, bulk material is used that is already available at the erection site of the protective structure, so that this material does not have to be transported to the site of the protective structure.

In order to put up sufficient resistance to the moving mass, a certain ballast volume of the individual wall elements is preferably provided. This ballast volume is preferably at least 0.5 $m^3$ or preferably at least 1 $m^3$ or preferably at least 5 $m^3$ or preferably at least 15 $m^3$ or preferably at least 20 $m^3$. Furthermore, an upper limit for the ballast volume is preferably provided so that the wall element is not designed to be excessively heavy and consequently remains movable. The upper limit for the ballast volume is preferably 200 $m^3$.

The wall element preferably has several walls. In particular, a bottom wall is provided which rests on a bearing surface. Extending upwards from this bottom wall is at least one front wall, which forms the front face of the wall element and faces the moving mass. Furthermore, several side walls may be provided which also extend upwards from the bottom wall. For example, in a cuboid configuration of the wall element, the wall element has two side walls and a rear wall in addition to the front wall.

A lid wall may be provided on the top side of the wall element. However, it is also possible to leave the upper side of the wall element open.

It is preferably provided that at least one of the walls is formed as a grid, a net or a closed surface, preferably made of sheet metal.

According to one possible embodiment, a shipping container (also referred to as an iso-container) is used as the wall element. When using the shipping container, all walls are formed as closed surfaces; if necessary, the ceiling wall is removed. Thus, the present disclosure includes the use of shipping containers as wall elements; in particular, 8 foot, 20 foot or 40 foot containers are used in this regard.

However, it is also envisaged to use any other three-dimensional body made of the same or different walls, i.e. with mesh, net or closed surface, as a wall element. In particular, it is envisaged that the wall element has a stable frame, for example made of steel beams, and this frame may be planked with different walls on its sides.

The connection arrangements between the wall elements may be of different or identical design within the one protective structure. Accordingly, one protective structure may be designed in several embodiments of the connection arrangement which are described in the following:

Preferably, it is provided that at least one connection arrangement comprises a trapping structure. This trapping structure in particular is a trapping net or a trapping rope.

Furthermore, it is preferably provided that at least one of the connection arrangements comprises a braking element. The connection arrangement, optionally with additional connection elements, may comprise only braking elements. Alternatively, however, it is also possible to combine at least one braking element with the above-mentioned trapping structure, so that the single connection arrangement comprises a trapping structure and at least one braking element.

In a well-known manner, the braking element comprises a structure provided for dissipative energy conversion, for example a metal element that is plastically deformed to brake any movement. For example, a braking element may include a wedge that moves through the plastically deformable structure for dissipative energy conversion.

In addition or alternatively to the trapping structure and/or the braking elements, the single connection arrangement may include at least one connection element: The connecting elements may be rigid elements, such as chain links and/or shackles. At least two of these rigid elements may movably engage with each other. Furthermore, the single connecting element may also be, for example, a cable, in particular a steel cable, or a bolt connection (also: hinge).

Furthermore, it is preferably provided that the single connection arrangement comprises a plurality of connection devices. Each connection device is thereby connected to both wall elements. In particular, the individual connection devices are arranged on top of each other to form the connection arrangement. For example, two to 20 of such connection devices are provided in a connection arrangement. Each connection device may in turn comprise in particular chain links and/or steel cables and/or braking elements.

As already described, each wall element has a front face used to face the expected moving mass. This front face may also be referred to as the uphill side. According to the front face, a front half or a front third can be defined on the wall element. Preferably, it is provided that at least one of the connection arrangements, in particular all connection arrangements, is/are mounted on the wall element exclusively in the front half, preferably in the front third, of the respective wall element. This has the following advantage: it is assumed that the mass hits the center of the chain of several wall elements. As a result, the central wall element (or the several wall elements that are to be assigned to the center) is pushed away from the mass. The laterally arranged wall elements thereby move inwards and with their front faces moving towards each other. To enable this movement from a more or less linear arrangement of the chain to a U-shaped arrangement, without putting excessive tensile stress on the connection arrangements, the connection arrangements are preferably arranged on the wall elements as far to the front as possible.

Depending on the application, it may also be useful to arrange at least one connection arrangement in the region of the downhill side of the respective wall element: Each wall element has a rear face facing away from the front face. This rear face may also be referred to as the downhill side. According to the rear face, a rear half or a rear third can be defined on the wall element. Preferably, it is provided that at least one of the connection arrangements, in particular all connection arrangements, is/are mounted on the wall element exclusively in the rear half, preferably in the rear third, of the respective wall element. This has the advantage that the impact mass can fill up the free space between the wall elements, thus stiffening the mobility of the wall elements with respect to each other—as a result, at the beginning of the mass impact, there still is a relatively large mobility against, which, however, decreases with increasing filling of the free space.

In particular, the single protective structure has several cavities between wall elements and thus also several connection arrangements. Consequently, at least one connection arrangement may also be arranged on the uphill side and at least one connection arrangement may be arranged on the downhill side in a protective structure.

Furthermore, the present disclosure shows a method for protection against moving masses, in particular for decelerating the moving mass. In this case, the described protective structure is set up on a slope, a foot of a slope or in a river bed, so that the wall elements are movable in relation to each other and across the bearing surface by a mass moving down the incline, namely avalanche, rockfall, mudslide or logging. In particular, the wall elements are actually moved in relation to each other and across the bearing surface by the moving mass.

In particular, the method involves initially positioning the wall elements at the desired location and in an empty state in the course of erecting the protective structure and subsequently filling them with ballast, in particular bulk material.

Furthermore, the use of the protective structure described above on an incline or a bottom of an incline or in a riverbed is provided as a protection against the moving masses, namely avalanches, rockfalls, mudslides, or loggings.

In the following, an example embodiment of the protective structure 1 is explained in detail while making reference to the FIGS. 1 to 3. The protective structure 1 is used and positioned to decelerate a moving mass and thus to provide protection from the moving mass. In the schematic illustrations of FIGS. 1 to 3, the moving mass is expected to be in the impact direction 100.

The protective structure 1 comprises a plurality of wall elements 2. In the figures, three wall elements 2 are arranged adjacent to each other as an example. However, the protective structure 1 may also comprise only two of the wall elements 2 or more than three wall elements 2.

In each case, two adjacent wall elements 2 are connected to each other via a connection arrangement 3. In the example shown, the connection arrangement 3 comprises three connection devices 4 arranged on top of each other. Each connection device 4 is connected to both wall elements 2, respectively.

In each of the three figures, identical connection arrangements 3 are shown. However, it is also possible to use different connection arrangements 3 in a single protective structure 1.

FIG. 1 shows that the connection arrangement 3 may have chain links. By means of such chain links, or for example alternatively by means of steel cables, it is possible to firmly connect the wall elements 2 to each other on the one hand and, on the other hand, to allow relative movement between the wall elements 2.

Figure 2:
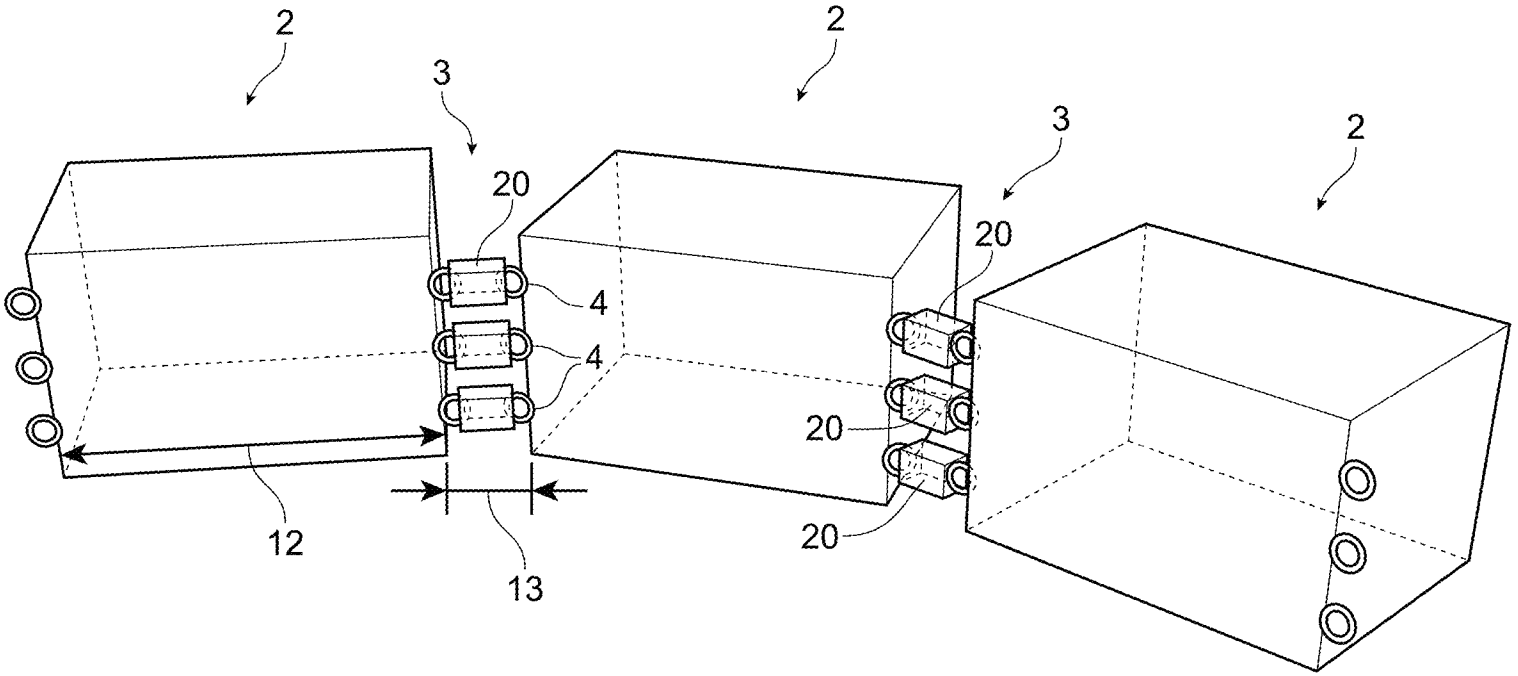
FIG. 2 shows a schematic representation of the protective structure according to the present disclosure according to the example embodiment with an alternative connection arrangement.

FIG. 2 shows that the connection arrangement 3 has three connection devices 4 arranged on top of each other, each having a braking element 20. Such braking elements comprise plastically deformable structures, in particular made of steel, which may be deformed for dissipative energy conversion. Using such braking elements 20, it is possible that upon mass impact the wall elements 2 not only rotate in relation to each other, but also move away from each other to a certain extent.

Figure 3:
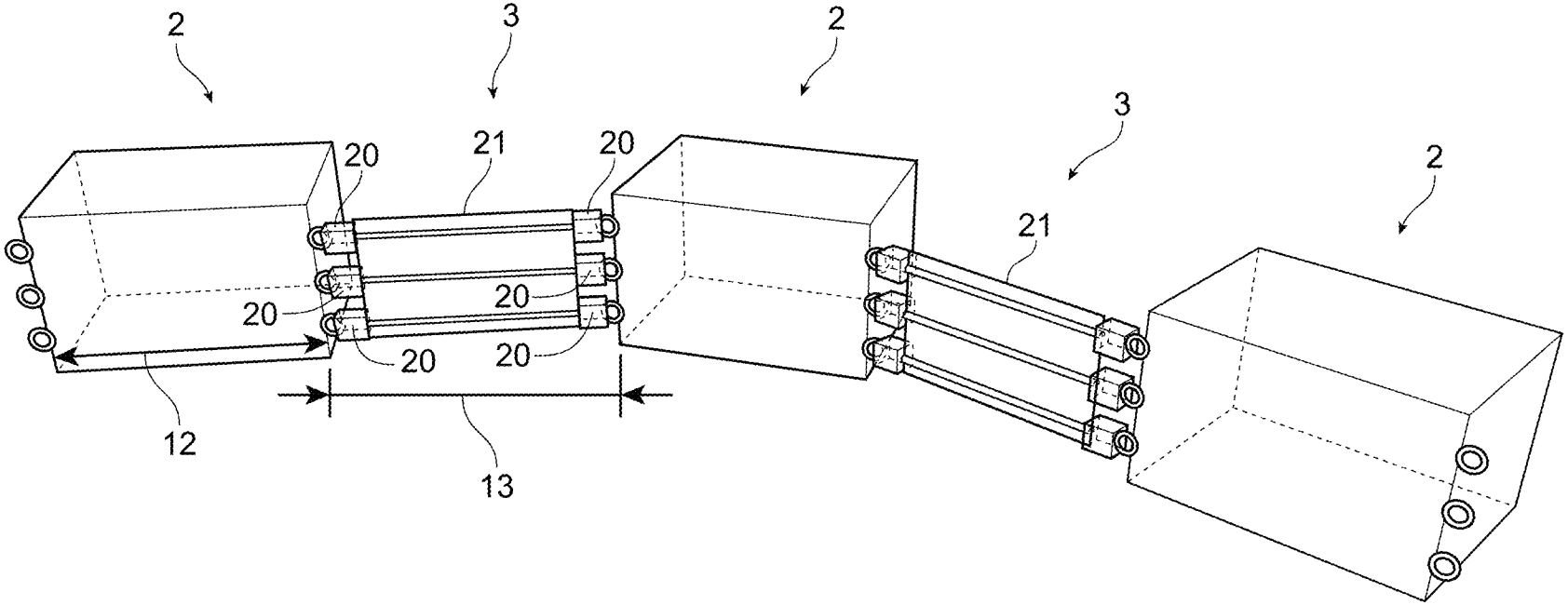
FIG. 3 shows a schematic representation of the protective structure according to the present disclosure according to the example embodiment with another alternative connection arrangement.

FIG. 3 shows a connection arrangement 3 with a trapping structure 21, herein designed as a trapping net. The trapping structure 21 extends between the two adjacent wall elements 2. Between the trapping structure 21 and the respective wall element 2, the connection arrangement 3 comprises braking elements 20, so that this is a combination of trapping structure 21 and braking elements 20.

The figures show that the connection arrangement 3 is mounted on the wall elements 2 in a maximally forward position, i.e. on the uphill side.

The schematic representations in the figures show the wall elements 2 without ballast. In fact, however, the wall elements 2 are filled, in particular completely, with ballast. The total ballast in the respective wall element 2 then forms the ballast volume of the wall element 2.

FIG. 1 illustrates that the wall element 2 has a bottom wall 5 with which the wall element 2 stands on a bearing surface. From this bottom wall 5, the front wall 7 extends upwards. Side walls 6 and a rear wall 9, facing the impact direction 100 are provided laterally and at the rear, respectively. A lid wall 8 may be inserted at the top. However, it is also possible to leave the wall element 2 open at the top.

The individual wall element 2 has a wall element height 10. What is particularly decisive herein is the height of the surface facing the impact direction 100, which in the example embodiment shown is the front wall 7. This surface facing the impact direction 100 has a wall element length 12. In the depth direction, in particular parallel or slightly inclined to the impact direction 100, the wall element 2 extends across a wall element depth 11. What is decisive for the definition of the wall element depth 11 is the side resting on a bearing surface, which in this case is the bottom wall 5.

Preferably, and independently of the example embodiment specifically shown herein, it is intended that the wall element depth 11 is sufficiently large in comparison to the wall element height 10 so that the wall element slides but does not topple over upon mass impact. In particular, it is provided for the wall element height to be at most 150%, preferably at most 120%, particularly preferably at most 100%, of the wall element depth 11.

Furthermore, the figures show a connection length 13 corresponding to the distance between the wall elements 2. In the variants according to FIGS. 1 and 2, the connection length 13 is relatively small, since in this case the connection arrangement 3 is formed via rigid elements or the braking elements 20. In the variant according to FIG. 3, the connection length 13 is correspondingly longer, since in this case the trapping structure 21 is arranged between the wall elements 2.

It is preferably provided, irrespective of the example embodiment specifically shown herein, that the connection length 13 is preferably 30 cm, in particular 50 cm, as a lower limit. Alternatively or additionally, it is preferred that an upper limit of the connection length is 30 m, in particular 10 m.

In addition to the foregoing written description of the present disclosure, explicit reference is herewith made to the drawing representation of the present disclosure in FIGS. 1 to 3 for additional disclosure thereof.

LIST OF REFERENCE NUMBERS

1 Protective structure
2 Wall element
3 Connection arrangement
4 Connection device
5 Bottom wall
6 Side wall
7 Front wall
8 Lid wall
9 Rear wall

10 Wall element height
11 Wall element depth
12 Wall element length
13 Connection length
20 Braking element
21 Trapping structure
100 Impact direction

The invention claimed is:

1. A protective structure for protection against a moving masses wherein the moving mass includes an avalanche, a rockfall, a mudslide, or a logging, the structure comprising:

a plurality of ballast-filled wall elements arranged in a manner adjacent to each other and spaced apart on a bearing surface; and a connection arrangement between each two adjacent wall elements, which connects the two adjacent wall elements and allows relative movement between the two wall elements, wherein the connection arrangement between at least two of the wall elements comprises a trapping structure connected to the wall elements by at least one chain link, shackle, cable, or bolt connection;

wherein the wall elements are movable in relation to the bearing surface and in relation to each other by the moving mass for dissipative energy conversion.

2. The protective structure according to claim 1, having at least three of the ballast-filled wall elements.

3. The protective structure according to claim 1, wherein the ballast of the ballast-filled wall elements comprises stones and/or soil and/or gravel.

4. The protective structure according to claim 1, wherein a ballast volume of the wall elements comprises at least 0.5 cubic meters.

5. The protective structure according to claim 1, wherein at least one wall of at least one of the wall elements comprises a grid or a net or a closed surface.

6. The protective structure of claim 5, wherein the closed surface comprises sheet metal.

7. The protective structure according to claim 1, wherein the connection arrangement between at least two wall elements is configured to allow relative rotational movement of the two wall elements.

8. The protective structure of claim 7, wherein the relative rotational movement is about a vertical axis.

9. The protective structure according to claim 1, wherein the connection arrangement between at least two wall elements comprises a braking element.

10. The protective structure of claim 9, wherein the braking element comprises a plastically deformable wedge.

11. The protective structure according to claim 1, wherein the connection arrangement between at least two wall elements comprises a plurality of connection devices arranged on top of each other, each connection device being connected to both wall elements.

12. The protective structure according to claim 1, wherein the wall elements have a front face facing the movable mass and a rear face opposite the front face, wherein at least one connection arrangement between at least two wall elements is mounted to the wall element exclusively in the front half of the respective wall element.

13. The protective structure of claim 1, wherein one or more wall elements of the protective structure comprise a shipping container.

14. The protective structure of claim 13, wherein each wall element has a height and a depth, and wherein the height is no more than 100% of the depth.

15. The protective structure of claim 1, wherein the trapping structure comprises a trapping net or a trapping rope.

16. The protective structure according to claim 1, wherein the wall elements have a front face facing the moving mass and a rear face opposite the front face, wherein at least one connection arrangement between at least two wall elements is mounted exclusively in the rear half of the respective wall element on the wall element.

17. The protective structure of claim 1, wherein each wall element has a height and a depth, and wherein the height is no more than 100% of the depth.

18. The protective structure of claim 1, wherein at least one wall of at least one of the wall elements comprises a grid or a net.

19. A method of protection against a moving mass, wherein the moving mass includes an avalanche, a rockfall, mudslide, or a logging, the method comprising:

erecting a protective structure according to claim 1 on an incline or on a bottom of an incline, such that the wall elements are movable in relation to each other and across the bearing surface by the moving mass moving down the incline.

* * * * *